United States Patent [19]

Milligan

[11] 3,961,790

[45] June 8, 1976

[54] HOCKEY STICK

[76] Inventor: Frank Milligan, 251 Riverside Drive, Oakville, Ontario, Canada

[22] Filed: Feb. 5, 1975

[21] Appl. No.: 547,362

[52] U.S. Cl. ..... 273/67 A

[51] Int. Cl.[2] ..... A63B 59/14

[58] Field of Search ..... 273/67 R, 67 A, 80.1–80.8; 145/2 R, 61 R; 403/333, 334, 339, 354, 361, 379; 285/328

[56] References Cited

UNITED STATES PATENTS

| | | | |
|---|---|---|---|
| 1,026,181 | 5/1912 | Seely | 273/67 A X |
| 1,130,610 | 3/1915 | Kane | 403/339 |
| 1,464,550 | 8/1923 | Thorpe | 273/80.8 X |
| 1,775,765 | 9/1930 | Hennessy | 403/379 |
| 2,300,514 | 11/1942 | Lewis | 403/354 X |
| 2,397,571 | 4/1946 | Sveda | 403/379 X |
| 3,369,265 | 2/1968 | Halberstadt et al. | 403/334 X |
| 3,489,412 | 1/1970 | Franck et al. | 273/67 A |
| 3,638,942 | 2/1972 | Bassett | 273/67 A |

FOREIGN PATENTS OR APPLICATIONS

| | | | |
|---|---|---|---|
| 447,077 | 3/1948 | Canada | 273/67 A |
| 455,116 | 3/1949 | Canada | 273/67 A |
| 489,072 | 12/1952 | Canada | 273/67 A |
| 633,295 | 12/1961 | Canada | 273/67 A |
| 86,713 | 2/1966 | France | 403/354 |
| 1,188,601 | 4/1970 | United Kingdom | 273/67 A |

*Primary Examiner*—Richard J. Apley

[57] ABSTRACT

A hollow plastic hockey stick is provided for use in combination with detachable plastic blades. The handle portion has wedge shaped recesses to receive corresponding embossed portions of the blade shaft in entered wedging relation therein, the blade shaft portion serving to support the handle recessed portions. A transverse bolt permits disassembly of the stick into its component parts.

6 Claims, 4 Drawing Figures

20

12
12
4
16
18
10

30
26
20
30
4
22

26
14
24
28

14

HOCKEY STICK

This invention is directed to a hockey stick, and in particular to a composite stick having separately fabricated blade and handle portions.

In use of hockey sticks, particularly for use in street hockey, where the blade portion of the stick is subject to undue wear, one solution has been the provision of a cast plastic blade having a socket portion into which a straight handle may be inserted, as shown in U.S. Pat. No. 3,638,942 F. W. Bassett issued Feb. 1, 1972.

Previous attempts to provide synthetically fabricated hockey stick handle portion for use with a blade such as a cast blade have generally proved unsuccessful, due primarily to the problem involved in securing the handle to the blade sufficiently rigidly, in full stress-transfer relation.

One object in accordance with the present invention is the provision of a synthetic fabricated handle portion for a hockey stick.

A further object is the provision of a fabricated handle portion for co-operation in stress transfer relation with a blade mounted thereon.

A further object of the invention is the provision of a strong light-weight hollow handle portion.

A further object of the invention is the provision of a synthetic fabricated handle portion having positive indexing registry with a blade when attached thereto.

The present invention thus provides a synthetic handle for use with a hockey blade to be attached thereto in secured relation extending in a first reference plane comprising a shaft member having wall portions extending therefrom to form a hollow stick end for attachment of the blade thereto, the wall portions being recessed to provide an inwardly tapered recess, the medial plane thereof being substantially coplanar with the first reference plane, the hollow end portion being shaped internally to receive a stub shaft portion of the blade in snug entered relation within the hollow end and in wedging indexed relation within the shaft wall tapered recess.

Certain embodiments of the invention are described reference being made to the accompanying drawings, wherein.

Figures 1, 2, 3, 4:
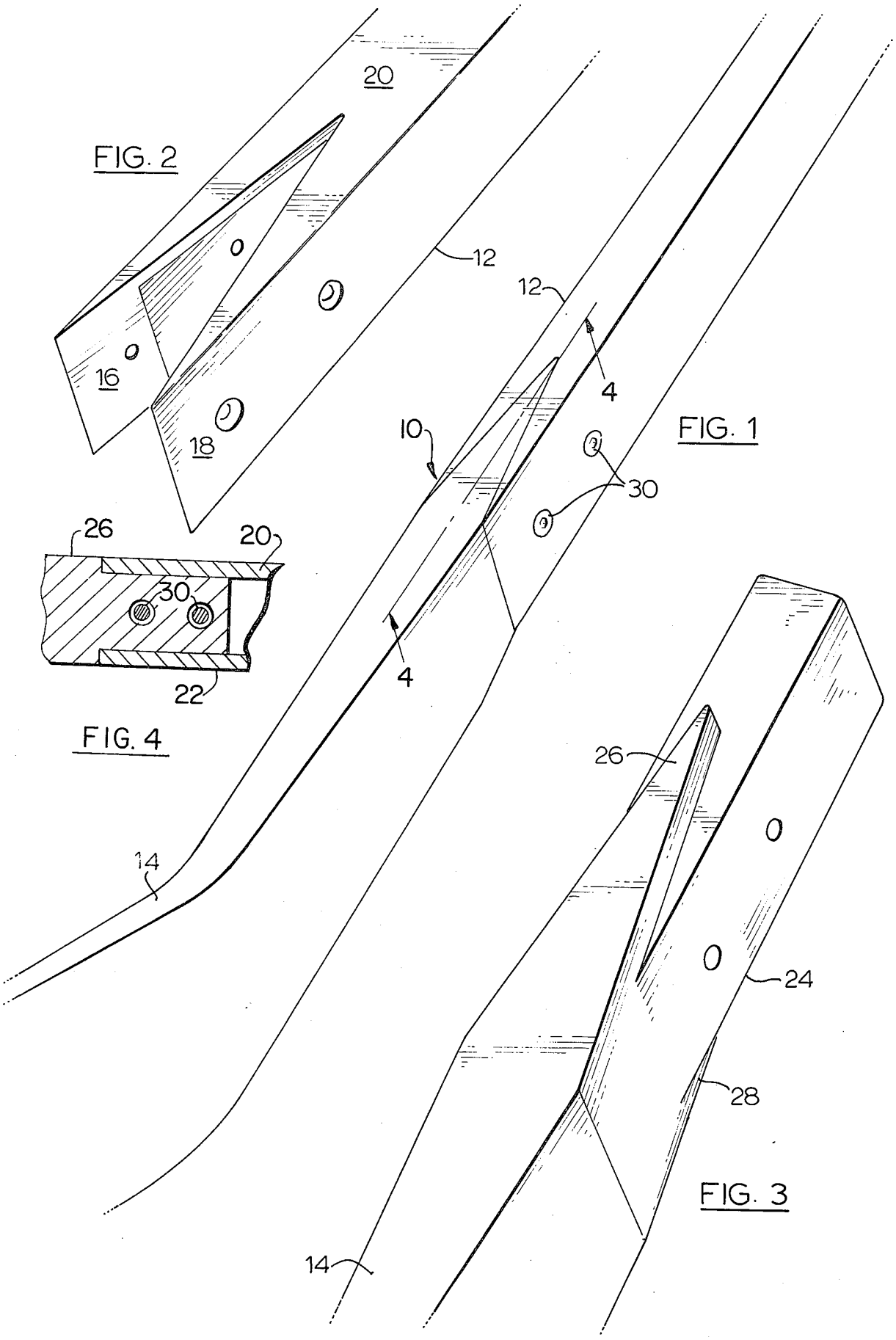
FIG. 1 is a general view of portions of a hockey stick in accordance with the present invention.
FIG. 2 is a like view of a portion of the handle.
FIG. 3 is a like view of the upper portion of the blade.
FIG. 4 is a section at 4—4 of FIG. 1.

Referring to the drawings, the hockey stick 10 has a handle portion 12 and a blade portion 14 shown in assembled relation. The handle 12 is of hollow section, at least at the lower end for attachment of the blade 14 thereat. In describing the handle as being of rectangular section it will understood that this generic term does not exclude a square section.

The hollow end of the handle portion 12 has a pair of opposed side walls 16, 18 and top and bottom walls 20, 22 (FIG. 4) forming a recess of rectangular cross-section to receive therein a blade shaft portion or spigot end member 24 of similar cross-section in snug fitting relation.

The top wall 20 and bottom wall 22 each have a wedge shaped recess extending through the wall thickness. The blade shaft portion 24 has a top wedge-shaped protrusion 26 and a bottom wedge shaped protrusion 28 each protruding from the shaft surface by an amount equal to the thickness of the walls 20, 22.

These protrusions 26, 28 fit snugly into the respective wedge-shaped wall recess of handle portion 12 in flush fitting relation therewith.

The insertion of fasteners 30 in bolting relation through the aligned bolt holes serves to draw the sides 16, 18 of the handle portion 12 into squeezing relation with the shaft portion 24, and to particularly mate the protrusions 26, 28 with the respective wedge shaped recesses of the top wall 20 and the bottom wall 22 in engaged wedging relation.

Owing to the form of attachment provided between the blade and the handle, there is precise registration therebetween, and loads acting on the blade are effectively transmitted to the handle, and vice versa.

At the same time, the combination readily lends itself to dis-assembly, for the purpose of replacing the blade.

While the latter facility particularly lends utility to the handle for playing street hockey, the invention makes possible the provision of a light weight handle that is not subject to fracture, under virtually any playing condition, thereby removing the ever present potential danger that a wooden handle possesses, if it breaks in a jagged fracture as is usually the case.

A further advantage afforded by the handle in accordance with the present invention is a reduction in the mass of the stick, with a consequent diminishment in its utility as a weapon.

Additionally, the stiffness characteristics of the stick can be tailored for specific classes of players by changing the wall thickness and or by adding ribs to the interior of the shaft.

Furthermore, in a game situation where it is beneficial for the stick to break to avoid injury to the player, the stick will break cleanly at the heel of the blade, rather than the shaft.

What I claim as new and desire to secure by Letters Patent of the United States is:

1. A hockey stick, having an elongated blade subject to undue wear in combination with a handle rigidly and readily detachably secured thereto by adjoing portions secured together in telescoped mutually gripping relation, one of said portions having a hollow end comprising a pair of opposed side walls and a top and a bottom wall to form the hollow end, said side walls each having at least one aperture therethrough in mutually aligned relation with the corresponding aperture in the opposite wall, the inner surfaces of said hollow end providing a socket of non-circular shaped cross section, said top and bottom walls each having a wedge-shaped recess therein through the thickness of the wall extending from the mouth of the hollow end a predetermined distance along the length of said one portion, the other said portion of the combination having a spigot end member with a cross section correspondingly shaped with said inner surfaces of said hollow end to provide torque resisting engagement therewith and to fit in stable engaging relation within said hollow end, a pair of oppositely extending wedge-shaped protuberances integral with said other portion protruding from opposite top and bottom surfaces of said spigot member to extend in flush fitting relation within said wedge-shaped recesses, at least one aperture extending through said spigot, positioned to fit in matching alignment with said related side wall apertures, and removeable fastening means extending through said aligned apertures to draw said side walls into gripping relation with two sides of said spigot and said spigot protuberances to provide a distributed edge contact zone acting over a predetermined axial extent of said telescoped portions.

2. The combination as claimed in claim 1 wherein said spigot member comprises a portion of said blade.

3. The combination as claimed in claim 1 wherein said hollow end portion comprises a portion of said handle, being of fibre-glass construction.

4. The combination as claimed in claim 3 wherein said handle is hollow throughout substantially the full length thereof.

5. The combination as claimed in claim 2 wherein said blade is of cast plastic construction.

6. The combination as claimed in claim 1 wherein said fastening means comprises a pair of axially spaced bolt means.

* * * * *